US010968711B2

(12) United States Patent
Jackson et al.

(10) Patent No.: US 10,968,711 B2
(45) Date of Patent: Apr. 6, 2021

(54) SHIFTING TOOL HAVING PUNCTURE DEVICE, SYSTEM, AND METHOD

(71) Applicants: Todd Christophe Jackson, Haarlem (NL); Roland Marcel Van Dort, Stonehaven (GB); Ewan Sinclair, Aberdeen (GB)

(72) Inventors: Todd Christophe Jackson, Haarlem (NL); Roland Marcel Van Dort, Stonehaven (GB); Ewan Sinclair, Aberdeen (GB)

(73) Assignee: BAKER HUGHES, AGE COMPANY, LLC, Houston, TX (US)

( * ) Notice: Subject to any disclaimer, the term of this patent is extended or adjusted under 35 U.S.C. 154(b) by 161 days.

(21) Appl. No.: 15/867,896

(22) Filed: Jan. 11, 2018

(65) Prior Publication Data

US 2019/0211636 A1 Jul. 11, 2019

(51) Int. Cl.
*E21B 23/01* (2006.01)
*E21B 29/00* (2006.01)

(52) U.S. Cl.
CPC ..... *E21B 23/01* (2013.01); *E21B 29/00* (2013.01)

(58) Field of Classification Search
CPC ..... E21B 23/01; E21B 23/03; E21B 31/002; E21B 34/14; E21B 34/063
See application file for complete search history.

(56) References Cited

U.S. PATENT DOCUMENTS

| | | | | |
|---|---|---|---|---|
| 4,479,557 | A | 10/1984 | Park et al. | |
| 4,512,422 | A * | 4/1985 | Knisley | E21B 7/068 175/230 |
| 5,026,903 | A | 6/1991 | Baker | |
| 5,146,983 | A | 9/1992 | Hromas et al. | |
| 5,413,173 | A | 5/1995 | Mills et al. | |
| 5,419,023 | A | 5/1995 | Hawkins et al. | |
| 5,765,640 | A | 6/1998 | Milne et al. | |
| 9,291,031 | B2 | 3/2016 | Frazier | |
| 9,382,778 | B2 | 7/2016 | Frazier | |
| 2002/0121373 | A1 | 9/2002 | Patel | |
| 2005/0263280 | A1 * | 12/2005 | Sellers | E21B 23/01 166/255.1 |
| 2007/0181298 | A1 | 8/2007 | Sheiretov et al. | |
| 2008/0202769 | A1 * | 8/2008 | Dupree | E21B 4/18 166/382 |
| 2009/0020290 | A1 | 1/2009 | Ross et al. | |
| 2009/0139720 | A1 | 6/2009 | Crazier | |
| 2012/0305267 | A1 | 12/2012 | Steele | |
| 2013/0014941 | A1 | 1/2013 | Tips et al. | |

(Continued)

OTHER PUBLICATIONS

International Search Report and Written Opinion for International Application No. PCT/US2018/062554; International Filing Date Nov. 27, 2018; Report dated Mar. 20, 2019 (pp. 1-13).

*Primary Examiner* — David J Bagnell
*Assistant Examiner* — Dany E Akakpo
(74) *Attorney, Agent, or Firm* — Cantor Colburn LLP

(57) ABSTRACT

A shifting tool includes a body having a longitudinal axis and a structure engaging member supported by the body. The structure engaging member is configured to engage and shift a structure within a tubular. A puncture device is supported by the body. The puncture device is configured to engage a barrier within a flowbore of the tubular in a direction of the longitudinal axis.

17 Claims, 3 Drawing Sheets

(56) References Cited

U.S. PATENT DOCUMENTS

| | | | | |
|---|---|---|---|---|
| 2014/0352976 | A1* | 12/2014 | Tinnen | E21B 31/00<br>166/377 |
| 2015/0337629 | A1 | 11/2015 | Zhang | |
| 2016/0312587 | A1* | 10/2016 | Montaron | E21B 29/06 |

* cited by examiner

SHIFTING TOOL HAVING PUNCTURE DEVICE, SYSTEM, AND METHOD

BACKGROUND

In the resource recovery industry, resources are often recovered from boreholes in formations containing the targeted resource. A plethora of tools are used in such operations, many of them needing to be actuated remotely. When a sleeve within the borehole needs to be moved, one conventional method for shifting the sleeve includes running a shifting tool within the sleeve and aligning keys of the shifting tool with corresponding recesses in the sleeve. While this method of shifting a sleeve is effective, different shifting tools need to be provided for sleeves having different recesses.

The art would be receptive to improved and/or alternative shifting tools and methods for operating within a tubular.

SUMMARY

A shifting tool includes a body having a longitudinal axis; a structure engaging member supported by the body, the structure engaging member configured to engage and shift a structure within a tubular; and a puncture device supported by the body, the puncture device configured to engage a barrier within a flowbore of the tubular in a direction of the longitudinal axis.

A method of operating within a tubular includes running a shifting tool within a tubular; selectively aligning a structure engaging member of the shifting tool with a structure within the tubular; radially moving the structure engaging member to engage with the structure; engaging a puncture device of the shifting tool with a barrier that blocks a flowbore of the tubular; and shifting the structure within the tubular.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
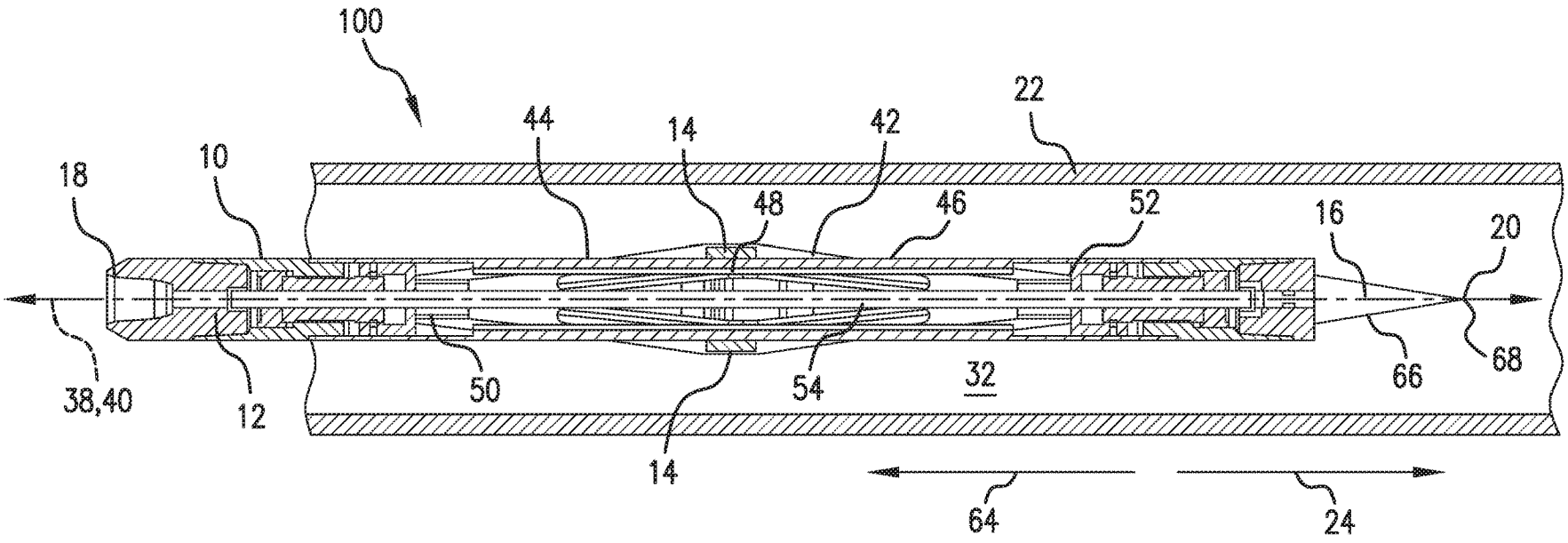
FIG. 1 depicts a sectional schematic view of an embodiment of a shifting tool in a run-in condition.
Figure 2:
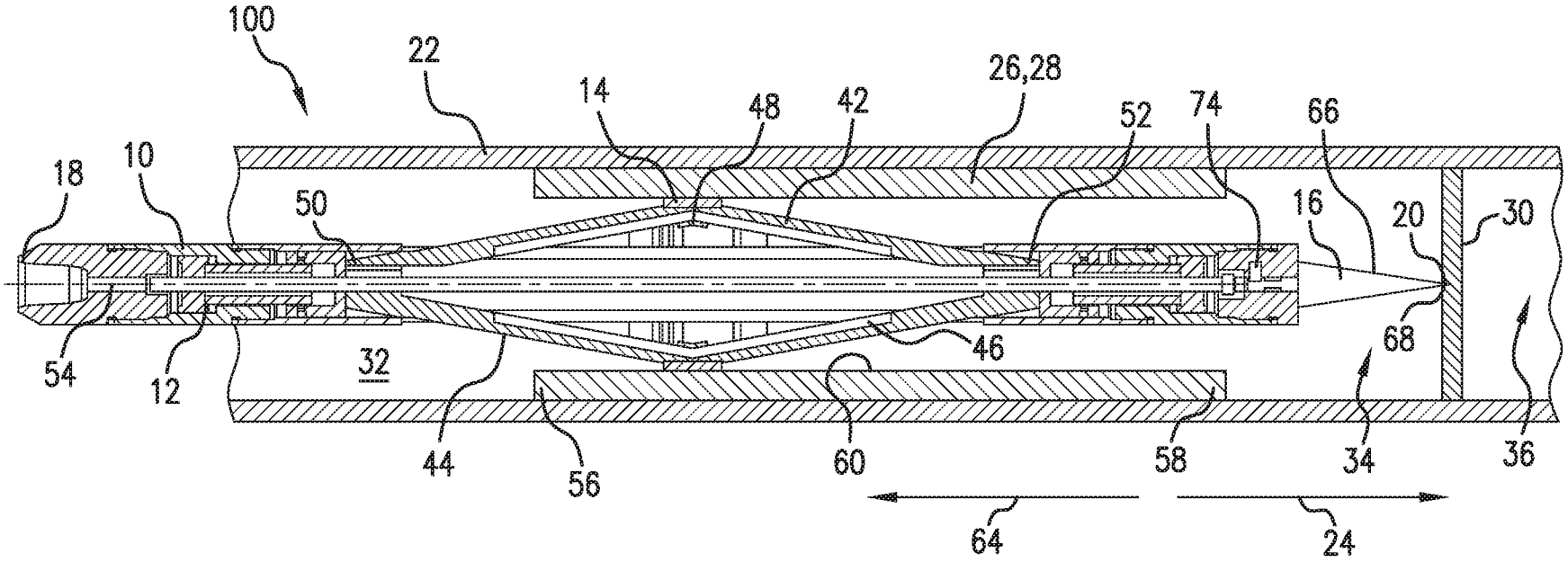
FIG. 2 depicts a sectional schematic view of the shifting tool of FIG. 1 in an expanded condition.

Referring to FIGS. 1 and 2, one embodiment of a shifting tool 10, for use within a system 100, includes a body 12 which carries a structure engaging member 14 and a puncture device 16. A first end 18, such as an uphole end, of the shifting tool 10 may be attached to any string, coiled tubing, piping, or wireline to move the shifting tool 10 to a desired location. The puncture device 16 is located at a second end 20, such as a downhole end, of the shifting tool 10, and the structure engaging member 14 is disposed between the first end 18 and the second end 20 of the shifting tool 10. In one embodiment of a method of operating the shifting tool 10, the shifting tool 10, while in a run-in condition, is run into a tubular 22 in a first direction 24, such as a downhole direction, as shown in FIG. 1. When a desired location is reached, such as adjacent a structure 26 disposed within the tubular 22 as shown in FIG. 2, the shifting tool 10 may be selectively expanded to engage the structure engaging member 14 with the structure 26. As illustrated, the structure 26 may include a sleeve 28 that is movable within the tubular 22. The puncture device 16 may be independently employed to engage a barrier 30 that blocks a flowbore 32 of the tubular 22 and that is located downhole of the structure 26. The puncture device 16 may be selectively used to pierce through the barrier 30 device to fluidically communicate an area 34 of the flowbore 32 uphole of the barrier 30 with an area 36 of the flowbore 32 downhole of the barrier 30. Through movement of the shifting tool 10, the structure 26 may be shifted at any time to engage with the barrier 30, such as to separate the barrier 30 from the tubular 22. Alternatively or additionally, the structure 26 may be shifted to reveal a radial port or perform another function as a result of shifting the structure 26 by movement of the shifting tool 10. Potential movements of the structure 26 include both longitudinal and rotational movements, which are under control of the shifting tool 10 once the structure engaging member 14 has engaged with the structure 26.

The shifting tool 10 in the run-in condition as illustrated in FIG. 1 has an outer diameter that is less than an inner diameter of the tubular 22 in which the shifting tool 10 may be run, so that the shifting tool 10 can easily pass therethrough. The shifting tool 10 has a longitudinal axis 38, which as illustrated coincides with the longitudinal axis 40 of the tubular 22, however during run-in of the shifting tool 10 through the tubular 22 the longitudinal axis 38 of the shifting tool 10 may be offset from the longitudinal axis 40 of the tubular 22. The shifting tool 10 includes an expandable portion 42, which is illustrated in a non-expanded or radially restricted condition in the run-in condition depicted in FIG. 1. The expandable portion 42 is radially outwardly movable from the non-expanded or radially restricted condition shown in FIG. 1 to a radially expanded condition shown in FIG. 2. The expandable portion 42 carries the structure engaging member 14 thereon to engage with the structure 26 (FIG. 2) within the tubular 22 when the expandable portion 42 is in the expanded condition. The structure engaging member 14 is at a greater radial distance from the longitudinal axis 38 of the shifting tool 10 in the expanded condition of the expandable portion 42 than in the restricted condition of the expandable portion 42.

One embodiment of the expandable portion 42 for the shifting tool 10 includes, but is not limited to, first and second arms 44, 46, including one or more first and second arms 44, 46, connected together at a hinge 48, which may be a living hinge or other hinged connection. The structure engaging member 14 is located at the hinge 48 such that the hinge 48 is the radial outermost portion of the expandable portion 42 during an expansion of the expandable portion 42 to place the structure engaging member 14 at a radial outermost position of the shifting tool 10 in the expanded condition. Alternatively, the first and second arms 44, 46 may be integrally connected into a single expandable flange, with the structure engaging member 14 placed at a central location of the flange. During expansion, a first angle between the first and second arms 44, 46 in the expanded condition (FIG. 2) becomes less than a second angle between the first and second arms 44, 46 in the restricted condition (FIG. 1). In one embodiment, the first and second ends 50,52 of the expandable portion 42 may be drawn closer together, as compared to the first and second ends 50, 52 in the restricted condition of the expandable portion 42 shown in FIG. 1. The longitudinal length of the expandable portion 42 may thus be shorter in the expanded condition than in the restricted condition.

One method of moving the expandable portion 42 from the restricted condition to the expanded condition includes hydraulic actuation where hydraulic pressure may be delivered through an interior passage or hydraulic chamber 54 of the body 12 of the shifting tool 10 to force the hinges 48 radially outwardly, thus pushing and forcing the structure engaging member 14 into secured engagement with the structure 26. That is, pressure can be applied in the chamber 54 which cannot escape past the second end 20 of the shifting tool 10, thus creating a backpressure which inflates the structure engaging member 14 radially outward. Alternatively, the expandable portion 42 may be activated into the expanded condition mechanically, such as by, but not limited to, pushing on the first end 50 of the expandable portion 42 while prohibiting longitudinal movement of the second end 52 of the expandable portion 42, thus forcing the expandable portion 42 to bulge radially outwardly at the hinge 48. While the expandable portion 42 has been described in one embodiment as having first and second hinged arms 44, 46 that carry the structure engaging member 14 at the hinge 48, the expandable portion 42 may alternatively include other mechanical, inflatable, and/or swellable members that are activatable by mechanical, electrical, hydraulic, magnetic, and/or chemical actuators to selectively move the structure engaging member 14 from the radially restricted condition shown in FIG. 1 to the structure-engaged position shown in FIG. 2.

Figure 3:
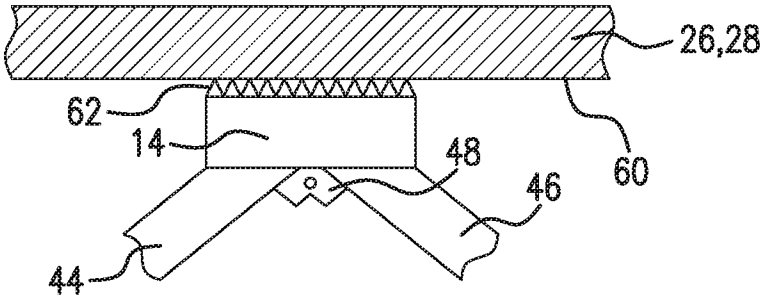
FIG. 3 depicts an enlarged schematic of an embodiment of a structure engaging member for the shifting tool; and, FIG. 4 depicts a schematic view of an embodiment of a puncture device in an extended condition.

Embodiments of the shifting tool 10 are configured to engage the structure 26 at any of more than one longitudinal location of the structure 26. Furthermore, as in the illustrated embodiment, the shifting tool 10 could be engaged with any longitudinal location of the structure 26, from a first end 56 of the structure 26 to a second end 58 of the structure 26. Thus, difficulties that may otherwise occur in aligning keys and dogs of a shifting tool with recesses and grooves in a structure are completely eliminated. Also, structures 26 that have an otherwise smooth interior surface 60 can be shifted. This enables the use of one shifting tool 10 to move a large variety of structures 26. One embodiment of the structure engaging member 14 that can engage with any longitudinal location of the structure 26 is shown in more detail in FIG. 3. The illustrated embodiment of the structure engaging member 14 includes one or more slips or teeth 62. In the run-in condition of the shifting tool 10, the shifting tool 10 can be located such that the structure engaging member 14 is aligned anywhere between the first and second ends 56, 58 of the structure 26. Then, in the expanded condition of the expandable portion 42, the structure engaging member 14 bites into or otherwise secures itself to the interior surface 60 of the structure 26. The shifting tool 10 can then be moved longitudinally with respect to the longitudinal axis 38 to shift the structure 26 in the desired longitudinal direction, such as in a second direction 64 (such as an uphole direction), the first direction 24, or both as needed. Alternatively or additionally, the shifting tool 10 can also be used to rotate the structure 26 within the tubular 22, in a circumferential direction of the structure 26. With the expandable portion 42 in the expanded condition, the structure engaging member 14 is retained in contact with the interior surface 60 of the structure 26 for at least as long as the desired shifting process.

Figure 4:
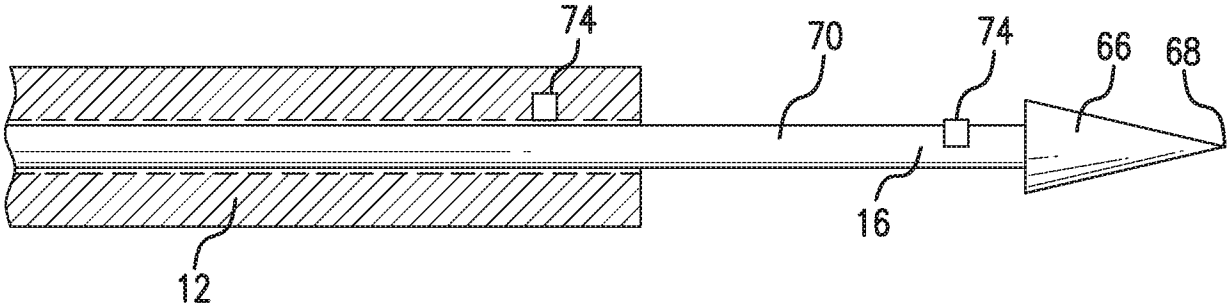

The puncture device 16 is configured to engage with the barrier 30 shown in FIG. 2. One embodiment of the puncture device 16, as shown in FIGS. 1, 2, and 4, includes a tapered piercing member 66 having a pointed end 68 at the second end 20 of the shifting tool 10. In one embodiment, the pointed end 68 is aligned with the longitudinal axis 38 of the shifting tool 10. In another embodiment, the piercing member 66 may include a blunt or rounded end but still tapered to create the desired effect of puncturing a barrier 30. Alternatively, the puncture device 16 may include a plurality of piercing members 66, with or without a pointed end, that are configured to engage a barrier 30 downhole of the structure 26 and which need not be aligned on the longitudinal axis 38. The puncture device 16 is configured to move longitudinally with respect to the longitudinal axis 38 and with respect to the body 12 of the shifting tool 10. That is, as shown in FIG. 4, the puncture device 16 may be moved away from the body 12 when engagement with the barrier 30 is desired. Movement of the puncture device 16 may be accomplished by an actuation mechanism, including, but not limited to, a mechanical actuation mechanism or a hydraulic actuation mechanism. One embodiment of a mechanical actuation mechanism includes a shifting rod 70, where the puncture device 16 is movable mechanically within the shifting tool 10 by the shifting rod 70. The puncture device 16, including the shifting rod 70, may be shear pinned to the body 12 to prevent premature and unintentional movement of the puncture device 16. FIG. 4 illustrates an embodiment where the shear pin 74 has been sheared to allow movement of the puncture device 16. The hydraulic actuation mechanism may include utilizing the same interior passage or hydraulic chamber 54 (see FIG. 2) that is used to expand the expandable portion 42. In some embodiments, the actuation mechanism may include a segment of the puncture device 16 that is shear pinned to the body 12 by one or more shear pins 74. When shear pinned as shown in FIG. 2, the application of a first pressure to expand the expandable portion 42 does not shear the shear pin 74, but the application of a second pressure greater than the first pressure shears the shear pin 74 and forces the puncture device 16 into, and potentially through, the barrier 30. Since the second pressure is greater than the first pressure, application of the second pressure maintains the structure engaging member 14 in gripping engagement with the tubular 22. Alternatively or additionally, a rupture disc may be provided within the hydraulic chamber 54 to prevent exposure of the puncture device 16 to the applied hydraulic pressure within the hydraulic chamber 54 until the rupture disc is ruptured by the second pressure. In an alternative embodiment, separate interior passages or hydraulic chambers 54 may be provided for separately hydraulically activating the expandable portion 42 and the puncture device 16 so that the puncture device 16 may be selectively moved independently of the expansion of the expandable portion 42 if desired, or to eliminate the need for the shear pin 74 and/or rupture disc.

Expansion of the expandable portion 42 to force the structure engaging member 14 into the structure 26 may thus occur independently from moving the puncture device 16 into the barrier 30. In one embodiment, after the barrier 30 is pierced and fluidic communication between the first area 34 and the second area 36 is introduced, the structure 26 may be shifted, such as by longitudinal movement of the shifting tool 10 which is connected to the structure 26 by the structure engaging member 14, in the first direction 24 and into the barrier 30, so as to sever the barrier 30 from the interior surface of the tubular 22.

Set forth below are some embodiments of the foregoing disclosure:

Embodiment 1: A shifting tool including a body having a longitudinal axis; a structure engaging member supported by the body, the structure engaging member configured to engage and shift a structure within a tubular; and a puncture device supported by the body, the puncture device configured to engage a barrier within a flowbore of the tubular in a direction of the longitudinal axis.

Embodiment 2: The shifting tool as in any prior embodiment or combination of embodiments, wherein the structure engaging member includes a plurality of slips or teeth.

Embodiment 3: The shifting tool as in any prior embodiment or combination of embodiments, wherein the structure engaging member is configured to engage the structure at any one of multiple longitudinal locations of the structure.

Embodiment 4: The shifting tool as in any prior embodiment or combination of embodiments, wherein the structure engaging member is connected to an expandable portion of the shifting tool.

Embodiment 5: The shifting tool as in any prior embodiment or combination of embodiments, wherein the structure engaging member is configured to move radially outwardly from a radially restricted condition of the expandable portion to a radially expanded condition of the expandable portion.

Embodiment 6: The shifting tool as in any prior embodiment or combination of embodiments, wherein the expandable portion includes a plurality of arms hingedly connected together and the structure engaging member is disposed at a hinge.

Embodiment 7: The shifting tool as in any prior embodiment or combination of embodiments, wherein the expandable portion is movable from the radially restricted condition to the radially expanded condition upon application of hydraulic pressure.

Embodiment 8: The shifting tool as in any prior embodiment or combination of embodiments, wherein the puncture device is at an end of the shifting tool.

Embodiment 9: The shifting tool as in any prior embodiment or combination of embodiments, wherein the puncture device is configured to pierce through the barrier.

Embodiment 10: The shifting tool as in any prior embodiment or combination of embodiments, wherein the puncture device is configured to move away from the body and longitudinally with respect to the longitudinal axis.

Embodiment 11: The shifting tool as in any prior embodiment or combination of embodiments, further including a shifting rod connected to the puncture device, and the puncture device is movable by longitudinal movement of the shifting rod within the body.

Embodiment 12: The shifting tool as in any prior embodiment or combination of embodiments, further including a hydraulic chamber in the body, the puncture device movable hydraulically by hydraulic pressure activation within the hydraulic chamber.

Embodiment 13: The shifting tool as in any prior embodiment or combination of embodiments, wherein the puncture device is movable longitudinally with respect to the body of the shifting tool, and the structure engaging member is movable radially outwardly from a longitudinal axis of the shifting tool.

Embodiment 14: The shifting tool as in any prior embodiment or combination of embodiments, wherein longitudinal movement of the puncture device is independently operable of radial movement of the structure engaging member.

Embodiment 15: A system including a tubular having a flowbore; a structure movably disposed within the tubular; a barrier disposed within the tubular arranged to block flow through the flowbore; and the shifting tool of claim as in any prior embodiment or combination of embodiments.

Embodiment 16: The system as in any prior embodiment or combination of embodiments, wherein the structure is a sleeve, the structure engaging member is radially movable with respect to the body to selectively engage with the sleeve; and the puncture device is longitudinally movable with respect to the body to pierce the barrier.

Embodiment 17: A method of operating within a tubular, the method including: running a shifting tool within a tubular; selectively aligning a structure engaging member of the shifting tool with a structure within the tubular; radially moving the structure engaging member to engage with the structure; engaging a puncture device of the shifting tool with a barrier that blocks a flowbore of the tubular; and shifting the structure within the tubular.

Embodiment 18: The method as in any prior embodiment or combination of embodiments, wherein engaging the puncture device with the barrier includes piercing the barrier to provide fluidic communication through the flowbore.

Embodiment 19: The method as in any prior embodiment or combination of embodiments, wherein engaging the puncture device with the barrier includes longitudinally moving the puncture device with respect to a body of the shifting tool.

Embodiment 20: The method as in any prior embodiment or combination of embodiments, wherein shifting the structure within the tubular includes longitudinally moving the structure into the barrier.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A shifting tool comprising:

a body having a longitudinal axis;

a structure engaging member supported by the body, the structure engaging member including a first end, a second end, and an expandable portion arranged between the first end and the second end, the first end and the second end being drawn together to radially outwardly extend the expandable portion to engage an inner surface of a tubular; and a puncture device supported by the body, the puncture device including one or more piercing members configured to move away from the body and longitudinally with respect to the longitudinal axis to engage and penetrate a barrier within a flowbore of the tubular in a direction of the longitudinal axis.

2. The shifting tool of claim 1, wherein the structure engaging member includes a plurality of slips or teeth.

3. The shifting tool of claim 1, wherein the structure engaging member is configured to engage a structure at any one of multiple longitudinal locations of the structure.

4. The shifting tool of claim 1, wherein the expandable portion includes a plurality of arms hingedly connected together and the structure engaging member is disposed at a hinge.

5. The shifting tool of claim 1, wherein the expandable portion is movable from a radially restricted condition to a radially expanded condition upon application of hydraulic pressure.

6. The shifting tool of claim 1, wherein the puncture device is at an end of the shifting tool.

7. The shifting tool of claim 6, wherein the puncture device is configured to pierce through the barrier.

8. The shifting tool of claim 1, further comprising a shifting rod connected to the puncture device, and the puncture device is movable by longitudinal movement of the shifting rod within the body.

9. The shifting tool of claim 1, further comprising a hydraulic chamber in the body, the puncture device movable hydraulically by hydraulic pressure activation within the hydraulic chamber.

10. The shifting tool of claim 1, wherein the puncture device is movable longitudinally with respect to the body of the shifting tool, and the structure engaging member is movable radially outwardly from the longitudinal axis of the body of the shifting tool.

11. The shifting tool of claim 10, wherein longitudinal movement of the puncture device is independently operable of radial movement of the structure engaging member.

12. A system comprising:

a tubular having a flowbore;

a structure movably disposed within the tubular;

a barrier disposed within the tubular arranged to block flow through the flowbore; and the shifting tool of claim 1.

13. The system of claim 12, wherein the structure is a sleeve, the structure engaging member is radially movable with respect to the body to selectively engage with the sleeve; and the puncture device is longitudinally movable with respect to the body to pierce the barrier.

14. A method of operating within a tubular, the method including:

running a shifting tool having a body within the tubular;

selectively aligning a structure engaging member of the shifting tool with a structure within the tubular;

radially moving the structure engaging member to engage with the structure;

engaging a puncture device of the shifting tool with a barrier that blocks a flowbore of the tubular; and shifting the structure within the tubular.

15. The method of claim 14, wherein engaging the puncture device with the barrier includes piercing the barrier to provide fluidic communication through the flowbore.

16. The method of claim 14, wherein engaging the puncture device with the barrier includes longitudinally moving the puncture device with respect to the body of the shifting tool.

17. The method of claim 14, wherein shifting the structure within the tubular includes longitudinally moving the structure into the barrier.

* * * * *